United States Patent [19]

Nuttin

[11] Patent Number: 4,805,501

[45] Date of Patent: Feb. 21, 1989

[54] SYSTEM FOR PROCESSING A WEB

[75] Inventor: Pierre Nuttin, Massagno, Switzerland

[73] Assignee: Fobelmac Consulting AG, Zug, Switzerland

[21] Appl. No.: 17,208

[22] Filed: Feb. 20, 1987

[30] Foreign Application Priority Data

Oct. 15, 1986 [CH] Switzerland ..... 04128/86

[51] Int. Cl.[4] ..... B26D 1/62

[52] U.S. Cl. ..... 83/300; 83/345; 83/349; 83/560; 83/571; 83/698

[58] Field of Search ..... 83/341, 342, 349, 699, 83/481, 549, 560, 571, 563, 559, 346, 344, 343, 331, 321, 345, 698, 300; 74/460, 665 F, 665 G, 665 GA

[56] References Cited

U.S. PATENT DOCUMENTS 3,869,950 3/1975 Serra ..... 83/341
4,119,003 10/1978 Corse ..... 83/341
4,346,635 8/1982 Krauss et al. ..... 83/481 X
4,413,541 11/1983 Biggar, III ..... 83/481 X
4,664,006 5/1987 Mitchell ..... 83/341

*Primary Examiner*—Frank T. Yost
*Assistant Examiner*—Rinaldi Rada
*Attorney, Agent, or Firm*—Spencer & Frank

[57] ABSTRACT

A system for processing a virgin web to yield printed documents such as business forms comprises a printing device adapted for printing non-repetitive (variable) and repetitive (constant) information and data as determined by a computer, and processing devices disposed—in relation to the transporting direction of the web—in front of and past the printing device and serving for shaping the web and possibly for printing onto the web in color. The processing devices are preferably built in the form of slide-in units adapted to be loosenably mounted into shelves of the system and to be driven for instance through separable connecting means by drive devices fixedly mounted on the frame. The system makes it possible to process the web within a small space and with small energy requirements, and to assemble and disassemble the processing devices with rapidity.

21 Claims, 6 Drawing Sheets

Fig. 3
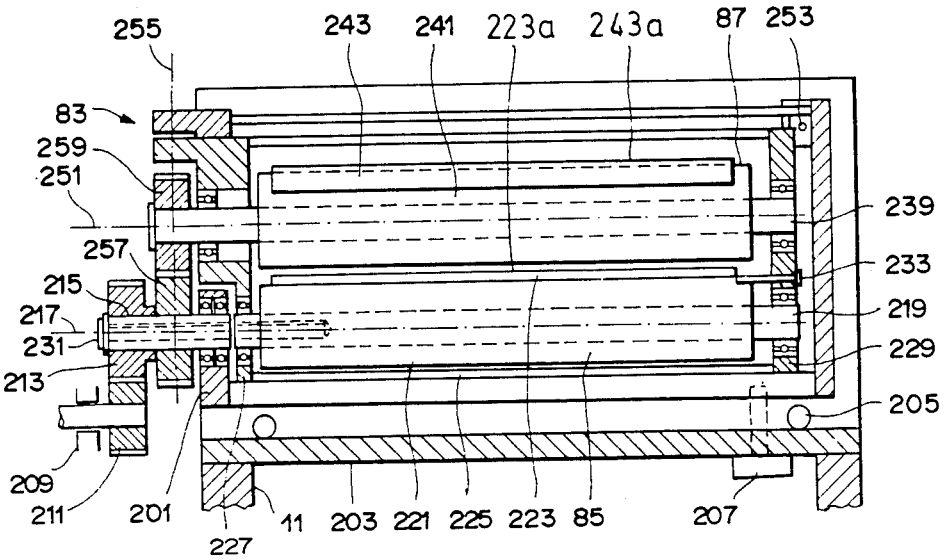
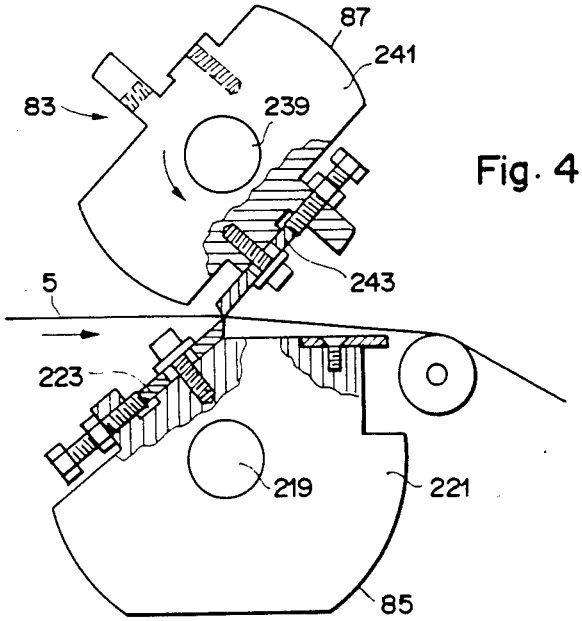
Fig. 4

Fig. 5
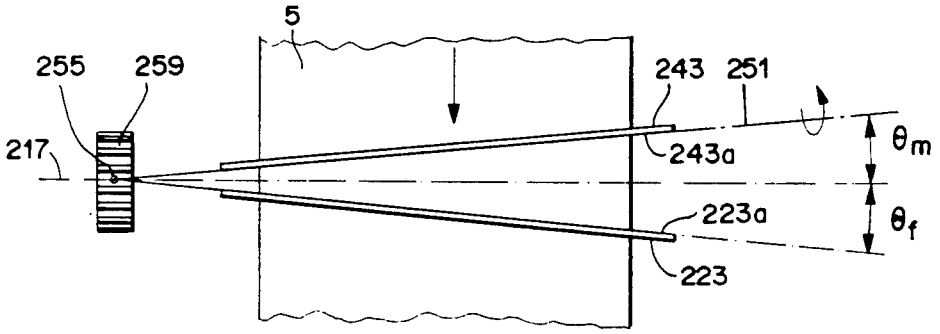
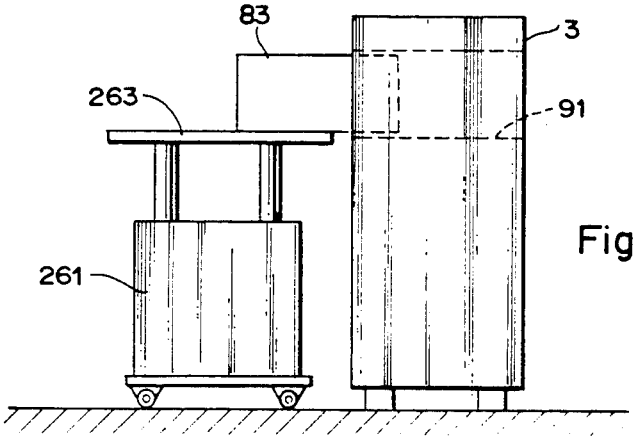
Fig. 6
Fig. 7
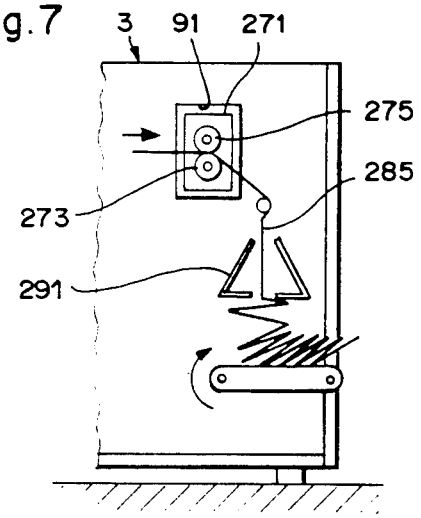
Fig. 8
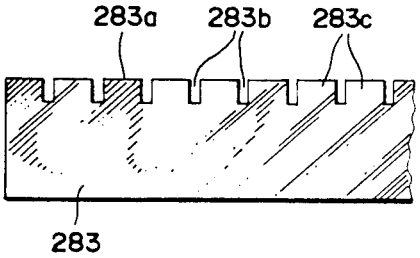

SYSTEM FOR PROCESSING A WEB

BACKGROUND OF THE INVENTION

1. Field of the Invention

The present invention relates to a new and improved system for processing a flexible web, such as a web comprising paper, for producing documents and/or envelopes therefrom.

The system may serve for processing one or several webs, preferably consisting in part or fully of paper, for producing documents therefrom. The term document as used here is meant to refer to a printed form such as a business form, preferably produced in larger lots, each document of each lot being arranged to comprise at least in part nonrepetitive information and/or data, i.e. information and data that vary from document to document and represent for example the name and address of the recipient and information and/or data concerning him individually. In addition to the data varying from document to document, the documents may contain printed information and data remaining the same for all of the produced documents or at least for a lot thereof; such information or data may be the name of the firm or the organization that produces the documents, and/or that mails them, furthermore the names of the documents, as for example "Confirmation of Order" or "Invoice", as well as dividing lines for separating columns and spaces. Subsequent to being printed upon the web may be shaped in various ways and may be cut up for example into sheets to be packed into different envelopes for mailing purposes. The system may also serve for folding the printed documents and connecting them, folded and at predetermined locations, to form of each document an envelope which may be torn open and which may contain on the outside the address of the recipient, and on the inside informations destined for the recipient. Instead of producing documents the system may be adapted to produce envelopes from a web for mailing documents therein. In the course of being produced the envelopes may be provided for example with the address of the sender, with other repetitive data and/or with a window.

2. Description of the Prior Art

The U.S. Pat. No. 4,611,799 discloses systems in which a virgin paper web, i.e. non-printed upon and non-perforated, is passed through a series of individual, autonomous units or devices and is converted into documents in processing steps carried out in the various devices partially or fully synchronously, i.e. on line. One such system disclosed in the aforementioned patent comprises a feed spool for feeding a web of virgin paper, a shaping device for perforating a marginal strip at each of the two longitudinal margins of the paper web, a printing device for printing repetitive data, a printing device for printing certain non-repetitive variable data dictated by a computer, and a second shaping device for cutting off the perforated marginal strip of the paper web, as well as for cutting up the paper web into sheets. Another system disclosed in said US-patent comprises a feed spool device, a shaping device for perforating the two longitudinal margin strips of the paper web, a printer for printing non-repetitive, variable information and data and a feed spool device for reeling off the web printed upon. During the operation of such or similar systems used in actual practice, the transporting means associated with the various devices are controlled by means of control devices in a way, to have the paper web form loops between the devices. This makes it possible to avoid excessive tension stresses in the paper web, even though the transporting means of the printing devices, controlled by a computer and adapted for printing the non-repetitive, variable information and data and comprising stepping motors, are arranged to move the paper web intermittently; at the same time the feed spool and shaping devices normally comprise relatively heavy and inert, transporting means adapted to be accelerated and braked at slow rates only. The systems known from U.S. Pat. No. 4,611,799 thus permit the on-line processing of a virgin paper web into completed documents; they possess however the disadvantage, that they require a relatively large number of different devices and separate transporting means; they are thus relatively expensive and their room requirements are considerable.

Shaping units used at present in practice generally comprise a frame, transporting means, and two processing members for processing the paper web; the processing members are supported on the frame rotatably around parallel rotational axes and adapted to be driven by a drive motor and to allow the paper web to be passed between them during operation. The devices serving for perforating the two longitudinal marginal strips of the paper web and arranged to face away from each other comprise for example two processing members. One of these serves as a matrix or die and—for punching two rows of holes—each comprises a number of holes or depressions distributed over its periphery and engaged during operation by fixedly held punches distributed over the periphery of the other processing member. Because of the wear incurring during the punching operation the punches must be replaced from time to time; this is accomplished in the known devices by individually replacing the punches in the processing member mounted in the frame. This has the disadvantage, that the device, and thus the entire system which the device is a part of, must be put out of operation for a relatively long duration, lasting for example for several hours. Furthermore, the two processing members of the known devices are supported in the frame non-adjustably, so that no possibility is provided for compensating for inaccuracies of fabrication; furthermore considerable friction losses may arise under certain conditions, the compensation of which may require drive motors of large capacity.

The devices conventionally used in practice for cutting off sheets from a paper web similarly comprise two processing members, specifically, two cylinders disposed one above the other and supported on the frame rotatably around two parallel axes and adapted to be driven by means of a drive motor. The lower cylinder processes a smooth, cylindrical support surface and consists at least in part of a particularly hard steel of a special kind; the upper cylinder, on the other hand, consists only of a semi-hard steel and carries at least one cutting knife parallel to its rotational axis. Each time the knife (or the knives) of the upper cylinder passes during operation by the lower cylinder, it strikes the paper web passed between the cylinders as well as the lower cylinder, and cuts a sheet off the paper web. In these devices too, the periodic replacement of the knife requires each time a relatively long interruption in the operation of the device and of the entire system. An additional disadvantage of these devices consists in that the impacts which occur while cutting off the sheets produce much noise and strong vibrations, as well as deflections of the cylinders. Since such deflections increase with the length of the cylinder, it becomes difficult or impossible to cut up paper webs having a width exceeding a certain critical value. Furthermore, the vibrations generated by the impacts and the large frictional forces which occur, demand a strong frame and a strong drive motor, thus increasing the room requirements as well as the manufacturing and operational costs. Furthermore, two cylinders of a certain diameter are only suited to cut off sheets having a length equal to the perimeter of the cylinder, or, if the upper cylinder comprises more than one knife, to the cylinder perimeter divided by the number of knives. Similar disadvantages exist in those known shaping devices, in which the knives comprise interrupted cutting edges rather than a continuous cutting edge, their purpose being to generate rows of holes to run perpendicular to the longitudinal direction of the web, and to serve as predetermined tear lines.

In other known shaping devices serving different purposes, such as cutting off the perforated margin strips or intermittently connecting two or more paper webs in a stamping process known as crimp lock process, or by gluing, it is generally required to periodically replace the rotatably supported processing members totally or partially, and/or at least to clean them; this, too, frequently requires relatively long interruptions in the operation of the system.

As mentioned before, it has been known from the U.S. Pat. No. 4,611,799 to equip such systems with a printing device adapted for printing repetitive information and data in addition to the printing device intended for printing non-repetitive, variable information and data determined by a computer. Printing devices for printing repetitive information and data also comprise two processing members, between which the paper web is passed through, at least one of the processing members being mounted for rotation, and the other being provided with a printing die (matrix). The replacement of this printing die may require—in the known printing devices - a relatively long interruption in the operation of the entire system.

SUMMARY OF THE INVENTION

It is one object of the invention, to avoid the above mentioned disadvantages of the known systems for processing paper webs or the like.

Another and more specific object of the invention is to create a system for processing paper webs in which the number of separate devices including transporting means and means for controlling said transporting means is reduced as compared to such number required in the known systems.

A further object of the invention is to create a system for processing paper webs, in which the replacement of the processing members may be accomplished more easily and more rapidly than in the known systems, thus avoiding any long interruptions in the operation.

The foregoing and other objects are attained in accordance with one aspect of the invention by providing a system for processing at least one flexible web, the web preferably consisting at least in part of paper, for producing documents therefrom, the system comprising a frame, a printing device supported on the frame and adapted to and to print variable information and/or data onto the web, transporting means for conveying the web past the printing device, said transporting means being arranged to comprise at least one transporting member movably supported on the frame and adapted to engage the web for conveying the same, furthermore at least one processing device comprising at least one rotatable processing member adapted to process the web conveyed past said member, electrical drive means for driving said at least one transporting member and said at least one processing member, electrical control means connected electrically with said drive means and adapted to control said drive means in such a way, that the rotatable processing member adapted to be driven by said drive means is set in rotational motion or is brought to rest substantially simultaneously with said at least one movable transporting member which engages the web, said processing member—when in rotation—being rotated with an angular velocity substantially proportional to the velocity of said transporting member to have the web printed on by said printing device and processed by said at least one processing device with synchronous timing.

BRIEF DESCRIPTION OF THE DRAWINGS

The invention shall now be explained with reference to the embodiments shown in the various figures of the drawing. The figures show:

FIG. 3 a section through a processing device for cutting up the paper web into sheets;

FIG. 4 a side view of the processing members of the processing device shown in FIG. 3, FIG. 5 a schematic top view showing the paper web and the knives of the processing device shown in FIGS. 3 and 4, to illustrate the cutting process, FIG. 6 a view of the system for processing a web shown in FIG. 1 and of a lifting device for mounting and unmounting a processing device, FIG. 7 a schematic side view of a part of a system unit comprising a processing device for producing perforations to run perpendicular to the paper web and a folding device, FIG. 8 a view of a knife having a cutting edge provided with interruptions adapted for producing perforations to run perpendicular to the paper web, FIG. 9 a schematic side view of a processing device for producing sorting holes, FIG. 10 a schematic side view of a processing device for connecting paper webs at intermittent locations in a stamping process, FIG. 11 a schematic side view of a processing device for gluing paper webs together at predetermined locations, FIG. 12 a schematic view of a processing device comprising an electrical drive device, FIG. 13 a schematic view of a printing unit together with adjacent processing devices adapted for shaping a web, FIG. 14 a schematic view of a shaping unit for producing rows of holes to run along the longitudinal margins of a web, FIG. 15 a schematic view of another shaping unit, FIG. 16 a schematic view of a unit for producing envelopes, FIG. 17 a schematic view of a system comprising a production chain consisting of individual units, and FIG. 18 a schematic illustration of a system comprising components similar to those shown in FIG. 1.

DETAILED DESCRIPTION OF THE PREFERRED EMBODIMENTS

Figure 1:
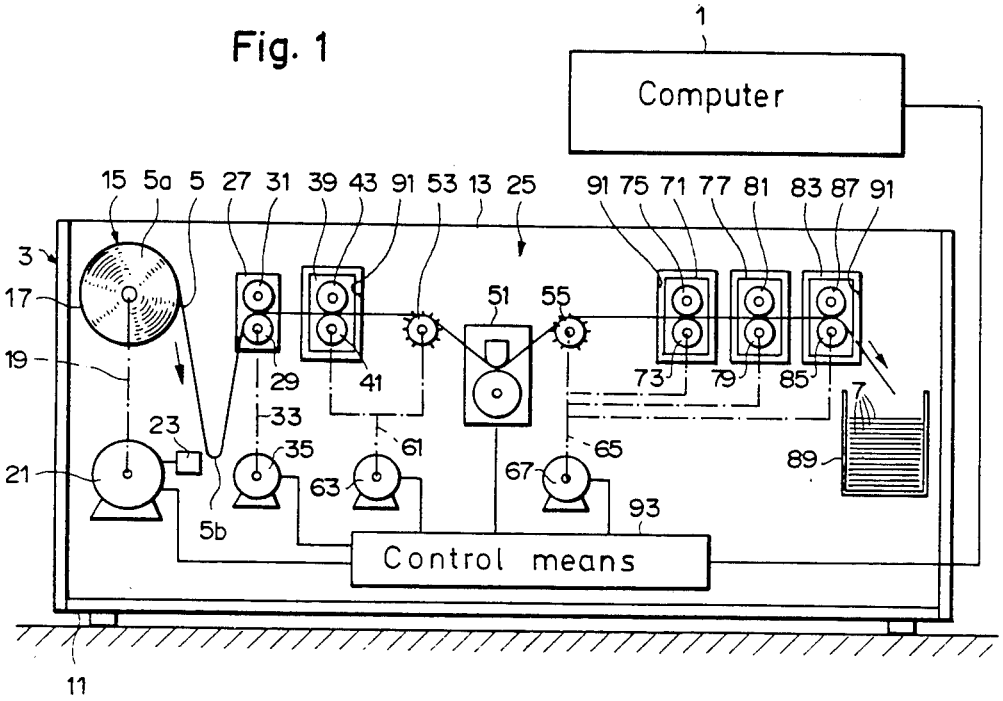
FIG. 1 a schematic illustration of a data processing system with an apparatus for processing a paper web to produce documents or business forms.

The system shown in FIG. 1 for the processing of data and for the production of documents or business forms comprises a digital computer 1 consisting of one or several individual units and an apparatus or assembly 3 for making documents 7 out of a paper web 5. The apparatus or assembly 3 which may consist for example of a continuous structural unit, comprises a frame 11 disposed on the floor of a room, and a housing 13 made of component parts connected with the frame 11; however the housing wall that faces the viewer as well as other components have not been shown in FIG. 1.

The upper left area of the assembly 3 of FIG. 1 shows a feed spool device or component 15. This component comprises a spool 17 supported on the frame 11 rotatably around a horizontal axis of rotation. On this spool 17 is wound the still virgin part 5*a* of the web 5, i.e. the part not yet printed on or perforated. The shaft of the spool 17 is connected for transmission of rotation with an electrical drive device 21, by way of a mechanical connecting means 19 indicated by means of a dash-dotted line and comprising for example a transmission. The feed spool device or component 15 is furthermore associated with an electrical control device 23 electrically connected with the drive device. This control device 23 comprises means adapted to control the motor of the drive device 21 during operation in such a way, that between the feed spool device and the adjacent shaping and printing device 25 the web forms a freely hanging loop 5*b* with constant slack and held for example by means of one or more compensating rollers. The control device may be built for example in the manner known from U.S. Pat. No. 4,611,799 previously quoted.

The shaping and printing component 25 comprises a transporting and guiding device 27 with transporting members 29, 31 supported rotatably around horizontal rotational axes disposed parallel to each other. These members 29, 31 in rotational connection with each other and—by way of mechanical connecting means 33 shown by a dash-dotted line and comprising for example a transmission—with an electrical drive device 35. These members 29, 39 engage—in operation—a section of the web 5 coming from the feed spool component, to transport and guide the same.

The shaping and printing component 25 also comprises a processing device 39 adjoining the transporting and guiding device 27 in the transporting direction of the web 5. As will be explained below with reference to FIG. 2 in further detail, the processing device 39 comprises two processing members 41, 43 rotatable around parallel axes of rotation and adapted to provide the web 5 passed during operation between said two members 41, 43 with a row of holes 5*d* at each of the two longitudinal margins 5*c* of the web 5.

The shaping and printing component 25 furthermore comprises a printing device adapted to print varying types of information and/or data, namely non-repetitive information and/or data and in general repetitive information too, said component being built for example in the form of a laser printing device. Furthermore, in addition to the transporting and guiding device 27 additional transporting means are provided and arranged to comprise for example at least two transporting members 53, 55, provided with teeth and displaceably supported on the frame 11, so as to engage with their teeth—before and after the printing device—the holes of the web produced by the processing device 39. In the embodiment illustrated in FIG. 1 the two transporting members 53, 55 consist each of a rotatable cylinder; however, they could also consist of conveying belts provided with teeth or of rotatable members adapted to drive the conveying belts. The rotatable processing members 41, 43 of the processing device 39 are connected with each other for rotation. Furthermore, the members 41, 43 and the rotatable transporting member 53 are connected with an electrical driving device by way of in part common mechanical connecting means 61. The transporting member 55 is connected for rotation—by way of mechanical connecting means 65—with an electrical drive device 67 fixedly mounted on the frame 11.

The shaping and printing component 25 comprises in addition to one or more processing devices located—in relation to the transporting direction—past the printing device 51 and the transporting member 55, three processing devices 71, 77 and 83 for example. The processing device 71 comprises two processing members 73, 75, one or both of them being supported rotatably around a horizontal axis of rotation. One of the two processing members 73, 75 possesses a printing matrix (die) for printing repetitive information and/or data and/or a printer for printing information and/or data varying in a predetermined way, and consisting for example of continuously increasing document numbers or page numbers. The processing device 71 furthermore comprises ink supply means, for example loosenably connected therewith, the information and/or data printed by the processing device 71 being arranged to normally comprise at least one color different from the colors contained in the information and/or data printed by means of the printing device 51. The processing device 77 comprises two processing members 79, 81 rotatable around two horizontal axes of rotation parallel to each other, one of the processing members being adapted to serve as transporting cylinder and as cutting support, the other processing member being provided with two disc-shaped knives having continuous cutting edges running along a circular line and adapted to cut off the perforated marginal strips of the web 5. The processing device 83, having a design and a method of operation to be explained below in detail with reference to FIGS., 3 to 5, comprises two processing members 85, 87, of which the upper processing member 87 is rotatable. The processing device 81 serves for cutting up the web 5 into sheets to form the documents 7 previously mentioned, which may be collected in a collector 89. The rotatable processing members of the processing devices 71, 77, 83 are connected for rotation with the drive device 67, by way of components of the connecting means 65 in part common to several processing devices and the transporting member 53.

Each of the processing devices 39, 71, 77, 83 is loosenably held within a shelf 91 of the assembly 3. By rims of openings provided in at least one side wall of the housing 13, adapted—if required—to be closed, these shelves 91 are defined below, on the two sides running transversely to the transporting direction of the web, and on top, said shelves 91 being accessible from the outside through these openings. In the inside of the housing 13 these shelves are delimited at least in part, on the bottom and possibly on portions of the sides and/or on top, by means of guide means shown in the FIGS. 2 and 3 described later on, and possibly by other frame and housing components. However, the two sides of the shelf disposed at right angles to the transporting direction of the web must comprise at least openings for the passage of the web 5.

All of the processing devices 39, 71, 77, 83 are displaceably guided in horizontal direction and at right angles to the transporting direction of the web 5, by means of the already mentioned guiding means. The processing devices 39, 71, 77, 83 are adapted to be loosenably secured and fixedly held in an operating position by way of securing means also indicated in the FIGS. 2 and 3, so that each processing device may be slid into a shelf 91 from one side of the assembly 3, it may then be secured in the shelf 91 in its operating position and again pulled out of the shelf.

Each electrical drive device 21, 35, 63, 67 is equipped with an electric motor. Since the drive device 21 must generate relatively large rotational moments for accelerating, rotating and braking the spool 17, it is equipped with a high output conventional motor, i.e. a motor which in operation steadily rotates. The rotatable transporting members 29, 31, 53, 55, on the other hand, require only smaller rotational moments and power outputs. Furthermore, the processing devices 39, 71, 77, 83 too are designed to have their rotatable processing members require only relatively small rotational moments and power outputs for accelerating, rotating and braking. The motors of the drive devices 63, 65 and preferably the motor of the drive device 35 too, are constructed in the form of stepping motors.

The drive devices 21, 35, 63, 67, the printing device 51 and additional electrical devices of the assembly 3 are electrically connected with electrical control means 93, said control means being arranged to comprise a small electronic digitally operating computer, such as a microcomputer or a micro processor and electronic means for signal adaptation. The control means 93 are electrically connected with the computer 1—comprising one or several components—and constitute together with the computer 1 the computing and control means.

Figure 2:
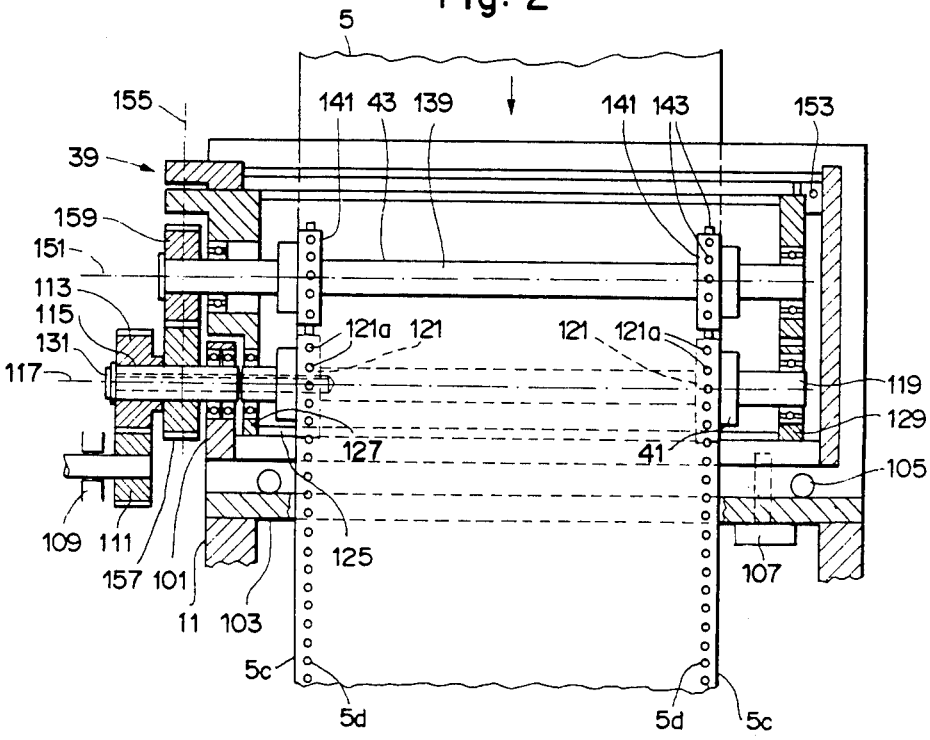
FIG. 2 a section through a processing device for perforating the paper web along its two longitudinal margins.

The processing device 39 shown separately in FIG. 2 comprises a support 101 consisting of several parts and built in the form of a frame, and displaying a generally rectangular shape. The support 101 is guided within the housing 13 by the previously mentioned guide means designated in FIG. 2 with 103 and comprising at least one rail rigidly mounted on parts of the frame 11 and at least partially delimiting the shelf 91 on the lower side of the processing device 39. The support 101 may be adapted, for example, to roll along the guide means 103 on roller elements 105 having the form of rollers or spheres. The securing means equally mentioned previously and indicated schematically and designated by 107 in FIG. 2 serves for loosenably securing the processing device 39 in the shelf 91. The securing means 107 possesses for example one or more locking devices, each comprising one component fixedly mounted on the guide means 103 and thus on the frame 11, and at least one movable locking member such as a pawl, which in the working position of the processing device 39 and of its support 101 engages the latter and secures it against displacements. The locking member may be, for example, manually movable from its open position to its locked position and vice- versa, or it may be biased by a spring and/or its weight in such a way, that when sliding the processing device 39 into the shelf 91 the lock snaps in by itself into the support, as soon as the latter has reached its working position. In the latter, preferred case, the securing means 107 may comprise a manuably operable actuating member, such as a push-button, connected with the or each locking member and arranged to move the or each locking member in the open position where it gives the support 101 free. Instead of a locking device the securing means may comprise some other device for rapid fastening, locking or screw fastening; however, they should be preferably built so, that the processing device, or, more accurately, its support, be adapted to be secured or loosened rapidly.

The connecting means 61 serving the purpose of creating a disconnectable rotational connection between the two rotatable processing members 41, 43 and the motor shaft of the drive device 63 lastingly fastened onto the frame 11 comprise a gear 111 rotatably supported in a bearing 109, in turn supported on the frame 11, and a gear 113 that sits torsionally rigidly on a hollow shaft supported on the support 101 rotatably around a horizontal axis of rotation 117 by means of a bearing comprising at least one rolling element. The processing member 41 comprises a shaft 119 and two disc-shaped punching tools 121, fixedly mounted on the shaft 119 and constructed as matrices and are provided with holes 121*a* uniformly distributed over their periphery. The ends of the shaft 119 are rotatably supported in bearings mounted with in the lateral members 127 and 129 of a holding member 125 constructed in the form of a frame and disposed within the support 101. The end of the shaft 119 of the processing member 41 is connected with the hollow shaft 115—loosenably and for rigid transmission of rotation—by coupling means 131 comprising, for example, a screw and entraining means. The coupling means 131 may be, for example so designed, to allow the adjustable displacement of the holding member 125 into positions, in which the rotational axis of the shaft 119 comes into alignment with the rotational axis 117, or perhaps it cuts the latter at a very small angle. The processing member 43 disposed above the processing member 41 comprise a shaft 139 and—fixedly mounted thereon—two disc-shaped punching tools 141, each of which being arranged to comprise a wreath of punches 143 distributed over its periphery and, for example, individually mounted in a lossenable fashion. The two ends of the shaft 139 are supported rotatably around a rotational axis 151 in bearings mounted in the lateral parts 127, 129 of the holding member 125. The holding member 125 is held in the support 101 and adapted to be continuously displaceable, for example by way of supporting and guiding means comprising an adjusting device 153, the holding member 125 being thus adapted to be tilted around a tilt axis 155 into any desired tilt position, the tilt axis 155 being arranged to cross the two rotational axes 117 and 151. The adjusting device 153 comprises for example a component fixedly mounted on the support 101 and comprising a scale and an adjusting screw disposed perpendicular to the tilt axis 155. A gear 157 is mounted fixedly and for rigid transmission of rotation on the hollow shaft 115 between the gear 113 and the lateral part of the support 101 facing the gear 113, the teeth of the ear 157 being arranged to engage the teeth of a gear 159 fixedly mounted on the shaft 139 for rigid transmission of rotation. The teeths of the two gears are constructed to permit small tilting movements around the aforementioned tilt axis 155 which passes through them. The teeth of the gears 157, 159 may possess for example teeth having in a top view perpendicular to the rotational axis of the particular gear flanks convexly curved to a slight degree. The tilt axis 155, for example, is exclusively defined by the teeth of the gears 157, 159. However, supporting means could possibly be provided for additionally supporting the holding members 125 in the support 101, to make it tiltable around the tilt axis 155.

FIG. 2 also shows a section of the web 5 passed between the two processing members 41, 43, this section being shown—for the sake of clarity—as coming from the rear and from the top, and going frontward and downward. During operation of the processing device 39 the drive device 63 drives the hollow shaft 115 by way of the two gears 111, 113. As a result, the processing member 41 connected with the hollow shaft 115 directly and for transmission of rotation, and the processing member 43, connected by way of the two gears 155, 157 with the hollow shaft 115 for transmission of rotation will also be driven. The punches 143 of the stamping tool 141 of the processing device 43 then engage the respective holes 121*a* of the stamping tools 121 of the processing device 41, with the result, that at each of the two longitudinal margins 5*c* of the web 5 a row of holes 5*d* running in longitudinal direction of the web 5 will get punched into each marginal strip of the web 5.

In the ideal case the guiding means 103, or more accurately the direction of displacement of the support 1 defined by the guiding means, as well as the rotational axis 117 run exactly perpendicular to the longitudinal and transporting direction of the web 5. If, as a result of possible manufacturing and/or assembly inaccuracies there should occur deviations from said ideal case, it will still be possible to adjust the rotational axes of the two processing members 41, 43 to be perpendicular to a plane running vertically and in the longitudinal direction of the web 5, owing to the tiltability of the holding member 125 around the tilt axis 155. The angle which may result between the rotational axis 117 and the rotational axis of the processing device 41 when adjusting the tilt position of the beam 125 is very small, as mentioned before, and will have a maximum value of 3°, in general 2° at the most and preferably 1° at the most. The adjustability of the directions of the rotational axes of the processing members 41, 43 contributes to the ability of accurately perforating the web 5 and to keep the frictional losses low during perforating and transporting the web, which in turn contributes to the possibility of keeping the power requirements of the stepping motor of the drive device 63 low. For the rest, the adjustable arrangement of the holding member 125 in the support 101, as described before, makes it possible to make these two parts and other parts of the processing device 39 identical or similar to a large extent as for the processing device 83 described in the following in more detail and which serves for cutting sheets off the web 5, in which device, however, the adjustability of the holding member serves a different purpose.

The processing device 83 separately shown in FIG. 3 possesses a support 201 constructed identical or similar to the support 101 and is guided displaceably in horizontal direction in the respective shelf 91, within the guiding means 203 fixedly mounted on the frame 11 and corresponding to the guiding means 103. There are also provided roller elements 205 corresponding to the roller elements 105. In addition there are provided securing means 207, identical with or similar to the securing means 107.

The connecting means 65 that serve the purpose of establishing a disconnectable connection for transmitting rotation from the drive device 67, fixedly and lastingly mounted on the frame 11, to the rotatable processing member 87 comprise a gear 211 constructed identical with or similar to the gear 111 and being rotatably supported—in analogy to the gear 111—in the frame 11 by means of the bearing means 209. The gear 211 is in engagement with the gear 213, which in turn is mounted torsionally rigidly on a hollow shaft 215, the hollow shaft 215 being supported by one or more bearings mounted on the support 201, rotatably around a rotational axis 217. In the ideal case the axis 217 runs exactly horizontal and at right angle to the longitudinal and transporting direction of the web. The processing member 85 comprises a shaft 219 and a longitudinal cutting fixture 221 rigidly mounted on the shaft 219; furthermore a knife 223 running parallel to the longitudinal direction of the fixture 221 and to the shaft 219 is rigidly but loosenably mounted on the upper side of the cutting fixture 221. The ends of the shaft 219 are supported—for example rotatably—within the lateral parts 227, 229 of a holding member 225 of the support 201. Coupling means 231 could be furthermore provided, to connect the shaft 219 torsionally rigidly with the hollow shaft 215. The shaft 219, however, is uncoupled and the processing member 85, or more accurately, its cutting fixture 221, is non-rotatably blocked on the lateral part 229 by means of a loosenable locking member 233. The processing member 87 located above the processing element 85 comprises a shaft 239 and a cutting fixture 241 mounted on the shaft 239 torsionally rigidly. At least one knive 243 is arranged to run parallel to the shaft 239 and rigidly but loosenably mounted on said cutting fixture 241. The two ends of the shaft 239 are supported by the lateral parts 227, 229 of the holding member 225, rotatably around a rotational axis 251. The holding member 225 is similarly or identically shaped and dimensioned as the holding member 125, and is held—an analogy to the holding member 125—in the support 201 by means of supporting and guiding means in a way to be continuously and steplessly adjustable by means of an adjusting device 253 of the supporting and guiding means. More specifically, the holding member 225 is arranged to be tiltable around a tilt axis 255 and to be held fast in desired tilt positions, the tilt axis 255 being arranged to cross the two rotating axes 217 and 251 at right angles. The adjusting device 253 is similar in construction to the adjusting device 153 and possesses for example a component fixedly mounted on the support 201 and comprising a scale and an adjusting screw. A gear 257 is mounted on the hollow shaft 215 adjacent to the gear 213 in a torsionally rigid manner, the teeth of the gear 257 being in engagement with the teeth of a gear 259 in turn mounted on the shaft 239 in a torsionally rigid manner. The teeth of the gears 257, 259 are designed—in analogy to the teeth of the gears 157, 159—to allow small tilting movements around the tilt axis 255 that passes through them.

Each knife 223, 243 comprises a cutting zone 223*a* and 243*a*, respectively, each with a cutting edge extending uninterrupted from one longitudinal edge to the other longitudinal edge of the web to be cut up. As ay be seen from FIG. 4 the cutting fixture 241 is designed to be provided, as desired, with one knife 243 as shown or with two knives disposed diametrically opposite one another. Each of the knives 223, 243 is mounted by means of clamping and adjusting screws on the respective cutting fixture 221, 241, adjustably in a direction perpendicular to the longitudinal axis of said respective cutting fixture. If the processing member 87 is rotated during the operation of the processing device 83, then the cutting zone 243*a* of its knife 243 moves once during each rotation over the cutting zone 223*a* of the knife 223, preferably without touching the same, while the web 5 passed between the two processing members 85, 87 is cut up in a shearing-like processing operation, in a manner to be explained later in more detail. The adjustable fastening of the knives 223, 243 in the cutting fixtures 221, 242 allows the optimum adjustment of the minimum operational distance between the cutting edges of the knives in relation to the thickness of the web 5.

The shafts 219 and 239 of the two processing members 85 and 87, respectively, are supported on the holding member 225 so that they, and thus the knives 223 and 243 held by them, as well as the cutting zones 223*a* and 243*a*, respectively, are skew relative to each other and arranged to run parallel to a horizontal intermediary plane disposed between the two processing members 85 and 87 and parallel to the rotational axis 217 and perpendicular to the tilt axis 255. In a projection onto this intermediary plane however, they form an angle with each other. In this projection the cutting zone 223*a* of the knife 223 of the non-rotatable, i.e. stationary, processing member 85 forms an angle $8\theta_f$ with a straight line parallel to the rotational axis 217 and perpendicular to the transporting direction of the web, the angle $\theta_f$ being visible in FIG. 5. The rotational axis 251 of the processing member 87 and the cutting zone 243*a* of the knife 243, or of each knife 243, mounted on the member 87 rotatably around the rotational axis 251, forms in the projection of the aforementioned intermediary plane with a straight line parallel to the rotational axis 217, an angle $\theta_m$ visible in FIG. 5. The FIG. 5 illustrates a case, in which the adjustable holding member 225 is in a tilted position, in which the two angles $\theta_f$, $\theta_m$ have the same absolute value, but different signs. Attention is called to the fact, that the angles $\theta_f$ and $\theta_m$ have been drawn in FIG. 5 to an exaggerated size and have in reality absolute values of maximum 3°, but preferably of maximum 1°, and for example between 0.2° and 0.4°.

If during operation the web 5 with its two marginal strips provided each with a row of holes 5*d* cut off by means of the processing device 77, is made to pass between the two processing members 85, 87 of the processing device 83, then the processing device 87 becomes rotated in a rotational direction in which its peripheral part momentarily facing the web 5 moves essentially in the transporting direction of the web, specifically in FIG. 5 from the top of the page in downward direction. If now the movable knife 243 is moved in this direction, across and past the stationary knife 223, then the two cutting zones of the two knives cross each other at first at their ends located in FIG. 5 at left, after which the crossing point moves along the stationary cutting zone 223*a* toward the right. During this movement of the crossing point of the cutting zones 223*a*, 243*a* the web will get cut off from the left to the right in a shearing off operation. During this cutting operation both the web 5 and the crossing point of the two cutting zones move in the transporting direction of the web. Upon suitable selection of the process parameters the web will be cut along a line, which in relation to the web itself is at least essentially straight, and at least essentially perpendicular to the longitudinal and transporting direction of the web. A cut of this kind may be achieved by selecting the peripheral speed at which the movable cutting zone 243*a* is rotated around the axis of rotation 251 so, that the crossing point of the two cutting zones will move with a velocity having its component in the transporting direction of the web 5 at least approximately but preferably exactly equal to the velocity of the web itself. A cutting operation taking place in this way by shearing off, produces no impact, or at least no impacts to speak of, but only slight friction and little noise. The processing device 83 may therefore be constructed in the form of a relatively light cassette-like slide-in unit, which may be slid into a shelf 91 in the described manner, and be driven by a stepping motor of relatively low power output.

The length dimension of a sheet cut off from the web 5 by the processing device 83 is obviously equal to the distance through which the web has been transported during the time interval between two consecutive cut-off operations. Experiments have shown, that the processing device 83 may be readily driven with peripheral knife velocities, which deviate pretty much from the web transporting velocity and are, for example, considerably larger than these. The length dimensions may be changed therefore, without changing the processing members 85, 87 themselves, by replacing the gears 257, 259 by two gears possessing a different transmission ratio, with the effect of changing the ratio between the peripheral speed of the knives 243 and the web transporting velocity. By tilting the holding member 225, the angles $\theta_f$ and $\theta_m$ may be adjusted so, that the web will again be cut exactly at right angle to its longitudinal and transporting direction. During the tilting of the holding member 225 the angle between the cutting zones 223*a*, 243*a*, corresponding to the algebraic difference $\theta_m - \theta_f$, remains constant. If necessary, the holding member may also be tilted into positions, in which the rotational axis 251 of the rotatable processing device 87 is tilted parallel to the rotational axis 217 or to the same side of said axis as is the cutting zone of said knife 223. However, the cutting edge of the stationary knife 223 must form with the transporting direction of the web 5—in all positions—an angle slightly different from 90°. It is possible, for example, to provide exchangeable pairs of gears 257, 259, to cut up the web into sheets 304.8 mm (12 inches), 279.4 mm (11 inches) or 203.2 mm (8 inches) long. Aside from that the sheet length may evidently be changed by mounting, as desired, one or two knives onto the cutting fixture 241.

Due to the fact, that all of the processing devices 39, 71, 77, 83 serving for shaping and printing, as well as the printing device 51 for printing non-repetitive information and/or data, are built into the same apparatus or assembly 3 and are supported by the same frame 11, the room required for processing the virgin paper web 5 into completed documents is relatively small. Furthermore a system with the apparatus 3 may be produced cheaper than a system which comprises several separate shaping and printing units or devices, each with its own transporting and drive device. Also, the operation of the apparatus 3 requires less energy than the operation of known systems, in which separate shaping devices with autonomous drive and control devices are located along the transporting direction of the paper web in front of and past the laser printing device.

Some details regarding the use of the system shall now be explained. During the operation of the system, data are digitally processed by means of the computer 1 while documents, i.e. business forms, are produced by means of the apparatus 3; these may be invoices, letters of credit or messages of some sort. The documents to be produced may all have the same format or different formats, while as a rule a number of documents having the same format are produced in one lot. The computer 1 supplies the apparatus 3, specifically the control means 93 thereof, with information relative to the documents to be produced, and the control means 83 then perform the control of the various devices of the apparatus or assembly 3. The sections of the web 5 required for the production of the documents are steadily reeled off the spool 17 in virginal state, i.e. as paper with no perforations or print. They are then provided by the processing device 39 with the rows of holes **5*d* and then transported by means of the transporting members 53, 55 engaging the holes of the rows of holes 5*d* to the printing device 51 adapted to print information and data supplied by the computer 1. These data and information comprise changeable, non-repetitive data referring to a particular document, such as a date, the address of the recipient and other data referring thereto, and also, in general, data and information remaining the same for an entire series of documents, such as the name of the company or of the organization producing the documents, the name of the document type, and printed lines separating fields and columns. The web 5 printed on by the printing device 51, normally in one color, say black, reaches then the processing device 71 which, for example, prints onto the web 5 information and/or data in at least one different color. These information and/or data may be the same for an entire series of documents and contain for example the trade mark of the company producing the document; and/or the may change in predetermined fashion and represent for example a document number or a page number. Subsequently, the web is transported by additional not shown transporting members that may be provided, and/or by the processing devices 71, 77, 83 themselves, to the two processing devices 77 and 83. These devices will cut off the marginal strips comprising the rows of holes 5*d*, and will cut up the web in the manner described before into sheets to constitute the documents 7**.

The computer 1 and the control means 93 may be constructed so, for example, that the processing and the printing of the data take place simultaneously, i.e. in on-line operation. It is also possible, however, to store a certain mass of data fed out from the central unit of the computer 1 on a data carrier, such as a magnetic plate or diskette, and to subsequently read the stored data and feed it to the printing device 51.

The printing device 51 that constitutes the central and most important device of the apparatus or assembly 3 requires for its operation, in dependence of its construction and of the type of its data supply, a stepwise transportation of the web 5, for example one line or one page at a time, or at least a quasi continuous transportation of said web 5, the control means 93 being adapted to control the stepping motors of the drive devices 35, 63, 67 and of any additional drive devices that may be provided, in a way, to make the various transporting members 29, 31, 53, 55 convey the web in accordance with the requirements of the printing device 51 intermittently and stepwise or continuously to and past the printing device 51. Since the rotatable processing members of the processing devices 39, 71, 77, 83 are driven by the drive devices 63, 67 belonging to the means of transportation and adapted to drive the transporting members 53, 55, there will automatically and forcedly follow the result, that the rotatable processing members will be set in motion and brought to rest at least approximately, and in general exactly simultaneously with the transporting members 29, 31, 53, 55 engaging the web and adapted to transport the web through the printing device 51. When rotated, the rotatable processing members are rotated with a velocity, specifically a peripheral or angular velocity, proportional to the velocity with which the transporting members 29, 31, 53, 55 are arranged to move and to transport the web to and from the printing device 51. The stepping motors of the drive devices 35, 63, 67 may be accelerated and braked very quickly and strongly and started and stopped almost instantaneously during the beginning and the ending of a printing process for producing a number of documents and during the transport of the web if this transport takes place intermittently and stepwise during said printing process. In contrast thereto, the drive device 21 that comprises no stepping motor, but rather a motor adapted for continuous steady rotation is able to accelerate and brake the spool 17 which has a large mass and a corresponding by large moment of inertia only relatively slowly. Thus the spool 17 will, during the beginning and the ending of a printing operation and during the possibly intermittent transport of the web, not be accelerated, rotated and stopped synchronously with the drive devices 35, 63, 67, but rather it will be controlled by the control device 23 to impart the web a velocity that changes only comparatively slowly, while the loop **5*b*** makes compensation possible.

It may happen during operation that a component of a processing device, for example a punching tool 121 or 141 of the processing device 39, or a printing die of the processing device 71, or a knife of one of the processing devices 77 and 83 will have to be replaced because of wear or other damage. Furthermore, subsequent to having produced a batch of documents there could arise the need to print on another batch of documents repetitive data different from the data printed before, or to cut the documents to a different length; this would again require replacing some components, such as the printing die of the processing device 71 or the gears 257, 259 of the processing device 83, as the case may be. Such cases could be taken care of by providing a set of spare processing devices which—compared to the entire system—would only require little room and low expenditures. The particular processing device built into the apparatus or assembly 3, and of which at least one component must be replaced or changed, may then—subsequent to accomplished loosening of the securing means holding it mounted on the frame 11—be pulled out of the appropriate shelf 91 and replaced by a processing device of the spare set. The mounting or unmounting of the processing device, as illustrated in FIG. 6 in conjunction with the processing device 83, could be accomplished by means of a displaceable lifting device 261 comprising for example a table 263 hydraulically adjustable in height. The height of the table 263 is obviously set in a way to enable the processing device to be slid into the shelf 91 and pulled out therefrom essentially horizontally. A processing device may be replaced in a relatively short time, for example in 2 to 5 minutes, so that only a little of the operational time, so costly with large data processing systems, will be lost. It is selfunderstood, that a processing device comprising a component to be replaced, or requiring some other work to be done to it, must not necessarily be replaced itself, but may be pulled out of the shelf 91 temporarily and slid back into position after the required change has been carried out.

If, for example, only one-colored data must be printed and/or the perforated marginal strips of the web are not required to be cut off, then the processing devices not required for the momentary purpose may be removed from the apparatus 3, without replacement, rapidly and simply. However, there may be provided additional processing devices destined to perform other types of processes and mounted, as desired, into one of the shelves 91; furthermore, the number of shelves may be increased, if required. In the following, a number of processing devices will be described as being adapted to be mounted into the shelves 91 in lieu of the processing devices 71, 77, 83, or perhaps in addition to them.

For example, the processing device 83 may be replaced by the processing device 271 comprising two processing members 273, 275 and shown in FIG. 7. The two members 273, 275 are provided—in analogy to the processing members 85, 87—with knives, the knife 223 and/or the knife, or knives, 243 being replaced by a knife of the type of the knife 283, a section of which is shown in FIG. 8. The cutting zone 283*a* of the knife 273 is subdivided by notches 283*b* into teeth 283*c* and thus comprises a cutting edge provided with interruptions. The processing device 271 does not cut up the web 285 supplied to it into sheets, but rather provides the web with series of cuts or perforations running at right angles to the longitudinal direction of the web and intended to provide predetermined tear lines. If a processing device 271 as shown in FIG. 7 and producing predetermined tear lines is built into the apparatus 3, then the collector 89 may be replaced by a folding device 291 adapted to fold the paper web at the desired tear line, to produce endless forms running zigzag-shaped. As a further possibility, the system could also be equipped with a device adapted to be used, as desired, as a sheet collector or as a folding device. Furthermore, instead of the folding device another device could be provided to further process the web in some other way and, for example, to tear the web along the desired tear lines into sheets, subsequent to having performed certain intermediate processing steps.

Figure 9:
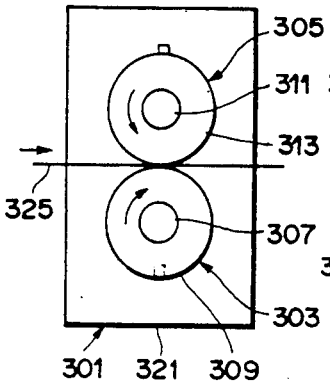

FIG. 9 shows a processing device 301 comprising two processing members 303 and 305 adapted to punch into the paper web 325 sorting holes for each document to be produced. These sorting holes are to comprise two or more holes disposed on a straight line perpendicular to the longitudinal direction of the web and adapted to enable the documents to be filed into a file. Each of the two processing devices 303, 305 possesses a shaft 307 and 311, respectively, and, mounted on the shaft 307 and 311 torsionally rigidly, at least one punching tool 309 and 313, respectively, comprising holes and punches, respectively, for punching the holes. The processing device 301 comprises a support 321 adapted to be slid into a shelf 91 and to be loosenably fastened therein. The shafts 307, 311 are supported for rotation, in a holding member—corresponding to one of the holding members 125, 225—and supported adjustably or non-adjustably in the support 321, or directly in the support 321, the shafts 307, 311 being connected by way of two gears for transmission of rotation and being adapted to be driven by way of a gear that corresponds to the gears 113, 213.

Figure 10:
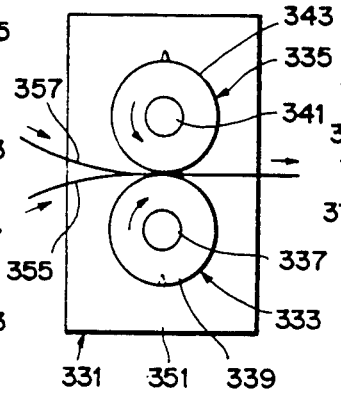

FIG. 10 showns a processing device 331 comprising two processing members 333 and 335, which in turn comprise one shaft each, 337 and 341, respectively, and a stamping tool 339 and 343, respectively, fixedly mounted on its respective shaft. Furthermore, the processing device 331 possesses a support 351 adapted to be mounted into a shelf 91. The shafts 337, 341 are rotatably supported in a holding member in turn supported in the support 351 or are directly supported in the support, and adapted to be driven by way of a gear which corresponds to the gears 113, 213. The stamping tool 339 is built in the form of a die and possesses a row of holes or depressions running for example parallel to its axis of rotation. The other stamping tool 343 comprises stamping punches adapted to connect at predetermined locations two or more paper webs 355, 357 supplied to the processing device 331 and consisting of similar or different types of paper, the connection to be a stamped connection referred to as crimp lock and adapted to produce documents consisting each of at least two sheets.

Figure 11:
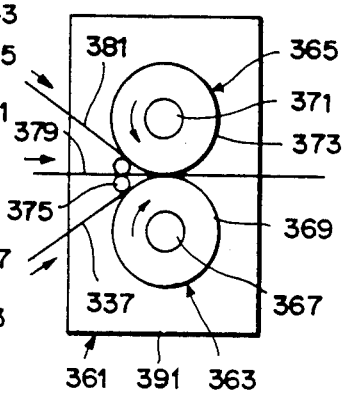

The processing device 361 shown in FIG. 11 comprises two processing members 363, 365, each comprising a rotatably supported shaft 367 and 371, respectively, furthermore adhesive supply means 375 and a support 391. The processing device is adapted to connect—by gluing or pressing together at predetermined locations—at least two, but for example three webs 377, 379, 381 with each other. An apparatus equipped with a processing device 331 or 361 must by necessity be also equipped with means for supplying and possibly preprocessing the additional paper webs.

Figure 12:
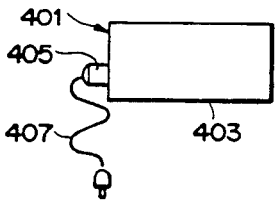

FIG. 12 shows a processing device 401 serving for example for carrying out one of the processes that may be performed by means of the processing devices previously described, the processing device 401 being arranged to comprise a support 403 and processing members supported in the support but not shown in the drawing, at least one of the processing devices being mounted for rotation. The processing device 401 possesses in lieu of the gears 113, 213 of the processing devices 39 and 83, respectively, an electrical drive device 405 fixedly mounted on its support 403, said drive device 405 being arranged to preferably comprise a stepping motor for driving the, or each, rotatable processing member. The processing device 401 may be loosenably mounted in a shelf of an apparatus or assembly corresponding to the apparatus or assembly 3, in a way analogous to the previously described processing devices. This apparatus or assembly however, possesses in lieu of the gears 111, 211, or in addition to these, an electrical connection, for example in the form of a connector electrically connected with the control means of the said apparatus, said connection making it possible, to connect the drive device 405 electrically separably with the electrical control means of the apparatus, by way of a cable 407 provided with a connector. The control means are adapted to control the drive device 405 during operation in such a way, that the or each processing member driven by the drive device 405 be driven synchronously with transporting members of the apparatus in a manner analogous to that described in conjunction with the processing devices 39, 71, 77, 83.

Figure 13:
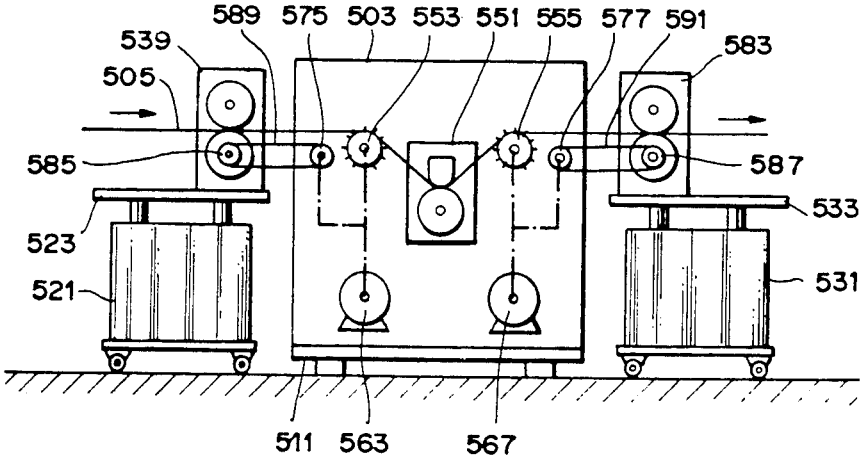

If, because of lack of space or for other reasons it is not possible to add to an existent printing unit or apparatus additional processing devices, such as for shaping a web to be built into shelves of the printing apparatus, then such processing devices may be added to the system without incorporating them into the printing unit or apparatus. FIG. 13 shows an example of such a system. The system shown in FIG. 13 possesses a printing unit or apparatus 503 comprising a frame 511, a printing device 551, specifically a laser printing device, adapted to be controlled by electrical control means—comprising a computer—in a way to print variable and repetitive data and information onto the paper web 505 fed by a feed spool not shown in the drawing. The unit or apparatus 503 furthermore comprises transporting means for transporting the web 595 and comprising rotatable transporting members 553, 555, and electrical drive devices 563, 567 for driving the transporting members. On each of the two sides of the printing unit or apparatus 503 which face in opposite directions, is disposed adjacent to said apparatus 503 a processing device 539 and 583, respectively, each comprising a support and two processing members. The processing device 539 disposed—in relation to the transporting direction of the web—in front of the printing device 551 is adapted for example—in analogy to the processing device 39—for producing rows of holes running along the two longitudinal margins of the web 505; on the other hand the processing device 583 disposed—in relation to the transporting direction of the web—past the printing device 551 may serve for example—in analogy to the processing device 83—for cutting off sheets. The apparatus 503 comprises—for each processing device—a gear 575 and 577, respectively, supported in the frame 511 and connected with the drive device 563 and 567, respectively, for transmission of rotation. The processing device 539 comprises a gear 585 rotatably supported in its support and—in analogy to the gear 113 is connected with its rotatable processing members for transmission of rotation, the gear 585 being connected with the gear 575 by way of a transmission member 589 consisting of a toothed belt or a chain. The processing device 583 comprises a gear 587 corresponding to the gear 213 and rotatably supported in the support and connected for transmission of rotation with the rotatable processing member of the processing device 583, the gear 587 being connected with the gear 577 by way of a transmission member 591, such as a toothed belt or a chain. Particularly in the case, in which the processing devices 539, 583 are to be placed near the apparatus 503 for a limited time duration only, they can be arranged to stand with their support, freely or fastened in some fashion, on table 523 and 533, respectively, being adjustable in height and belonging to a displaceable lifting device 521 and 531, respectively, said lifting devices providing the possibility of being secured, by means of braking means or the like, against non-intended displacements.

It is also possible to provide for the processing of a paper web, specifically for the shaping or the colored printing thereof, constructional units or, in brief, units without printing device for printing variable data fed from a computer and which may be referred to as peripheral units. Instead of providing such units with rotatable processing members run on bearings directly supported in conventional manner on the frame of the respective unit, they may be provided with shelves corresponding to the shelves 91, in which processing devices with at least one rotatable processing member are loosenably inserted. As will be explained in the following with reference to an embodiment illustrated in FIG. 17, units of this kind may constitute, for example, in connection with a printing unit comprising a computer-controlled printing device for printing variable nonrepetitive information or data, a system in the form of a production chain for the on-line processing of a web. The transporting members and the processing devices of such a system may be controlled in this case by the control means of the computer-controlled printing unit, or directly by the computer of the data processing system controlling said control means. This control may be such, that the web, as in the apparatus 3, will be transported in all of the processing devices in the same way as in the printing unit controlled by the computer, and will be arranged to print the variable data and information. However, it would also be possible to create of such units a production chain, in which the individual units are completely or partially autonomous, as it has been known from the U.S. Pat. No. 4,611,799 referred to before.

Figure 14:
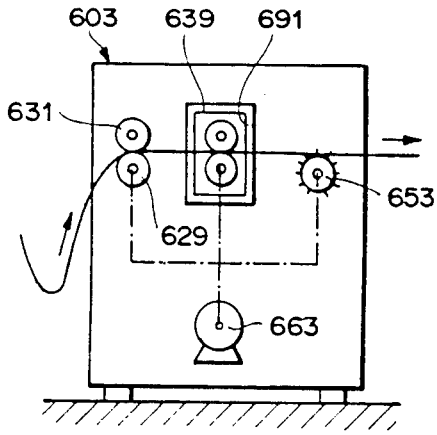
Figure 15:
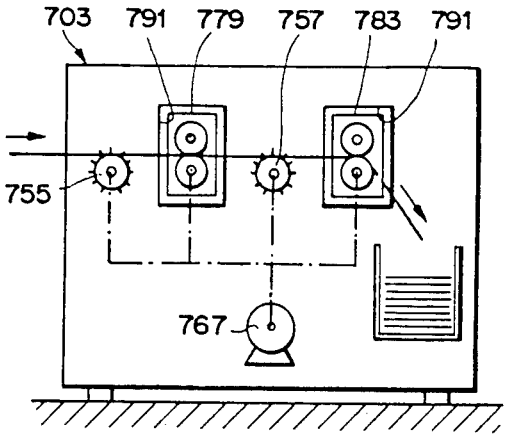
Figure 16:
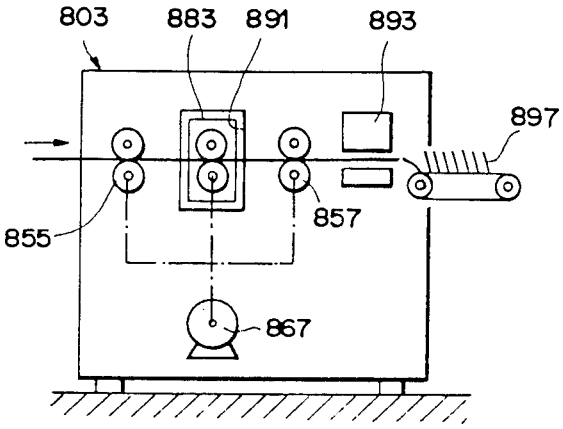

The FIGS. 14, 15 and 16 show examples of such units. The shaping unit 603 shown in FIG. 14 comprises a frame and transporting means with transporting members 629, 631, 653 rotatably supported in the frame and corresponding to the transporting members 29, 31, 53 of the apparatus 3, as well as at least one drive device 663 comprising an electrical motor. The unit 603 comprises a shelf 691 analogous to the shelves 91, in which a processing device 639 constructed similar or identical to the processing device 39 is loosenably inserted, the rotatable processing members of the device 639 being driven by the drive device 663, to punch into a web rows of holes running along the longitudinal margins of the web.

The shaping unit 703 shown in FIG. 15 comprises a frame and transporting members 755, 757 rotatably supported in the frame and adapted for transporting a web, said transporting members being adapted to be driven by an electrical drive device 767. The unit is equipped with two shelves 791, analogous to the shelves 91, the processing devices 779 and 783 being loosenably fastened within the shelves 791. The processing devices 779 and 783 comprise rotatable processing members adapted to be driven by the drive device 767. The processing device 779 may be adapted for example for punching sorting holes, and the processing device 783 for cutting up the web into sheets.

The unit 803 shown in FIG. 16 and serving for the production of envelopes 897 includes a frame, transporting means for transporting a web and comprising transporting members 855, 857, as well as one or more drive devices 867. The unit also includes at least one processing device 883 inserted into a shelf 891. The processing device 883 may be adapted, for example, to cut up the web into sheets, in analogy to the processing device 83. However, the processing device 883 may instead also serve to provide the web with perforations to form predetermined tear lines, or to connect sections of the web with other sections of the same web, for example by gluing them together at predetermined intervals, or to glue two or more webs together at predetermined locations. Furthermore, the unit 803 may be arranged to comprise more than one shelf 891, each for accommodating one processing device. In this way the unit may be equipped with several different processing devices serving for example for cutting off marginal strips comprising rows of holes running in longitudinal direction of the web, and/or for perforating and/or for cutting up the web into sheets, and/or for gluing webs together.

Figure 17:
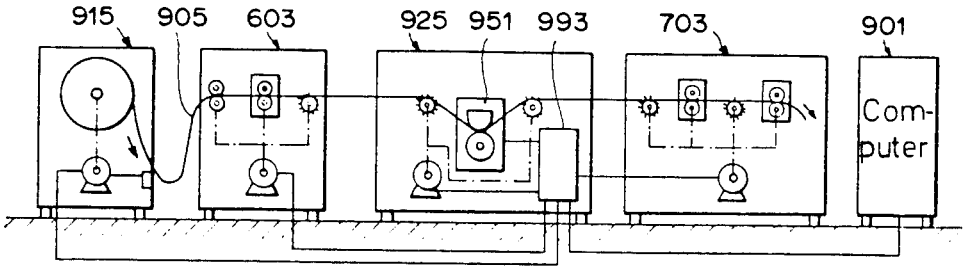

FIG. 17 shows the embodiment referred to before of a system comprising a computer 901 serving for data processing, and apparatus for processing a web 905 and comprising a production chain consisting of individual units, each provided with its own frame. Along the transporting direction of the web 905 there are disposed a feed spool unit 915, a shaping unit 603, a printing unit 925 and a shaping unit 703. The feed spool unit 915 comprises components similar to those of the feed spool device or component 15 of the system shown in FIG. 1, whereas the printing unit 925 comprises a printing device 951 similar to the printing device 51 and adapted to print non-repetitive data. There are provided, furthermore, transporting means comprising at least one drive device and control means comprising a small digital computer. The computer 901 is electrically connected with the control means 993 in turn connected with the printing device 951 and the drive devices of the various units. Under certain circumstances the connection with the drive device of the feed spool unit may be dispensed with.

In the production chain shown in FIG. 17 it would also be possible to replace the unit 703 by a unit 803 and to have the web printed onto in on-line operation with variable, non-repetitive information; furthermore, to have the web cut up into sheets by the processing device 883 and to use the device 893 to make the sheets into envelopes 897, the so-called folding letters, to contain on the outside the address of the recipient and information for the recipient on at least one page in the inside of the envelope.

The production chain shown in FIG. 17 could also be modified in a different way; it could be equipped for example with one additional unit or processing device for printing onto the web information in different colors and/or with a unit for folding the web.

Units of the kind shown in the FIGS. 14, 15 and 16 could, however, also serve for processing webs in off-line operation; this is understood to mean, that the web is printed onto in a separate operational step to take place—in regards to its timing—before or after the processing operation taking place in the processing devices of the respective unit.

If the unit 603 is to be used for off-line operation of this kind, it would be possible to provide a system comprising along the transporting direction of the web the following units in this order: a feed spool unit identical or similar to the feed spool unit 915, a shaping unit 603, a unit for rewinding the web comprising rows of holes running in its longitudinal direction, or for providing it with perforations running in transverse direction, or for folding the web. If a unit 703 or 803 is to be used in off-line operation, it would be possible to provide, for example, a system comprising a unit 703 or 803, as well as web supply means located in front of said units and adapted to supply the web printed onto. The web supply means may consist, for example, of a feed spool device or of a feed device which supports a web folded into a stack.

The apparatus 803 and its processing device 893 may, however, be adapted to produce windowed envelopes 897 out of the web having no print thereon. The processing device 883 or one of the processing devices additionally provided, if required, could be adapted in such a case to cut out the windows too.

Figure 18:
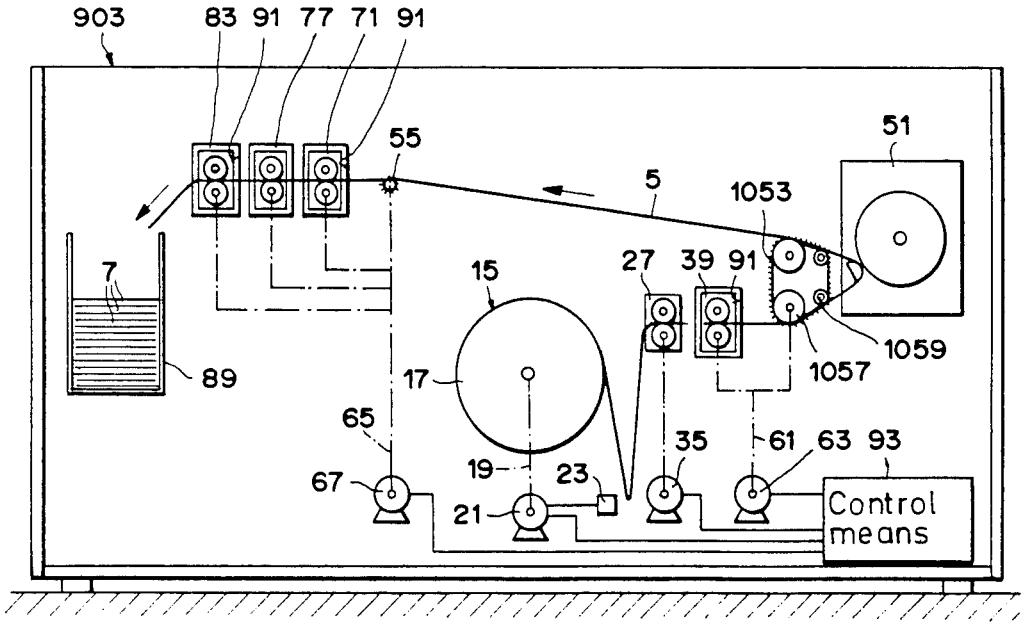

The apparatus or assembly 903 shown in FIG. 18 comprises largely similar parts as the apparatus or assembly 3 shown in FIG. 1, and differs from the same primarily by the different way of guiding the web 5. The spool 17 of the apparatus 903 is disposed between the printing device 51 and the collector 89. The web 5 runs from the spool 17 at first to the right across the transporting and guiding device 27, as well as across the processing device 39 to the printing device 51, and then away from the latter and to the left across the processing devices 71, 77, 83 to the collector 89.

The transporting means serving for conveying the web comprise, for example, in lieu of the rotatable transporting member 53 a movable transporting member 1053 realized as a conveying belt guided by means of the cylinders 1057, 1059 in a way to engage the web—in relation to the transporting direction of the web 5—both before and after the printing device 51. At least one of the cylinders 1057, 1059 is driven—in operation—by the drive device 63 and serves as transporting member for transporting the transporting member 1053. The cylinders comprise teeth engaging the longitudinal perforations of the transporting member 1053, which in turn comprises teeth engaging the holes of the web 5 produced by the processing device 39. The control means 93 which comprise a digital computer may be connected—in analogy to the apparatus 3 shown in FIG. 1—with a separate computer and/or it may itself comprise a reading device for reading the data from a data carrier, such as a magnetic diskette or plate or an optical data carrier. In the latter case, data magnetically or optically stored by a data processing system on a data carrier may be read by the reading device and printed, independent of the computer of the data processing system.

The systems, the units and the processing devices as well as their operation may be modified in various ways. In this connection attention is called to the fact, that the described embodiments may be combined with each other in various ways. In lieu of processing devices comprising rotatable processing members driven by a drive device of the transporting means, it is possible, for example, to provide in all of the described systems processing devices built like the processing device 401 and comprising their own drive device with its own motor; in this case the motor is arranged to be electrically connected with the electrical control means of the system, which the processing device is a part thereof. As another possibility, drive devices comprising a motor to serve exclusively for driving at least one processing device could be provided. Such drive devices could be fixedly mounted on the frame of the apparatus rather than to the support of the processing device. The motor of the drive device would then be electrically connected with the electrical control means of the respective apparatus and—by way of mechanical connecting means comprising a gear supported by the support of the processing device—with the, or with each, processing member of the processing device meant to be driven. In this connection attention is called to the fact, that the mechanical connecting means serving the purpose of creating a rotation transmitting connection between a drive device mounted on the frame and the, or each, processing member of a processing device to be driven could comprise a loosenable coupling of some kind, in lieu of a gear supported on the frame of the apparatus and in engagement with a gear supported on the support of the processing device.

The processing device 39 for producing the rows of holes 51 could be modified, for example, in the following manner: A processing member 41 comprising the punching tool 121 and serving as a die (matrix) 121 would not be connected with the hollow shaft 115 for rigid transmission of rotation, but be supported for free rotation; then, during operation, it would be rotated by the processing member 43, the punches 143 of which would engage the holes 121*a*. As another possibility, the holding member 125 could be mounted non-displaceably on the support 101. In this case, the special teeth of the gears 157, 159 adapted to make the pivoting around the pivot axis 153 possible, could be replaced by conventional teeth.

In the processing devices 77 adapted for cutting off the marginal strips comprising the rows of holes 5*d*, the knives provided with cutting edges running uninterrupted along a circular line could be replaced by knives having cutting edges with interruptions, to produce perforations to serve as predetermined tear lines, to enable the marginal strips with the rows of holes 5*d* to be torn off later.

In the processing device 83 adapted to cut up a web into sheets, the holding member could be subdivided into two holding members, only one of which to be pivotable around the pivot axis 255 and the other to be rigidly fastened on the support, so that the processing member 85 alone or the processing member 87 alone would be adjustable. If the rotatable processing member 87 would be supported non-adjustably, its rotational axis could form a small constant angle with a straight line perpendicular to the transporting direction of the web, or it could be parallel to said straight line. Since in the latter case the rotational axis of the gears 257, 259 would be permanently parallel to each other, it would be possible to replace the special teeth of the two gears 257, 259 by conventional teeth. However, in all of these variants the cutting edge of the stationary knife must from a small angle with a straight line running perpendicular to the transporting direction and parallel to the transverse direction of the web. It would also be possible to modify the processing device 83 so, that in operation both processing members would be rotated around their axes. In order to produce shearing operations yielding cut-off lines running essentially at right angles to the longitudinal direction of the web, it would be necessary to move the knives of the two processing members at peripheral velocities differing from each other in regard to direction of rotation and/or absolute value (magnitude). Evidently, all of the changes previously described with reference to the processing device 83 may be implemented in analogous manner in conjunction with the processing device 271 adapted for producing predetermined tear lines to run at right angles to the longitudinal direction of the web.

The roller elements 105, 205 of the various processing devices that make possible a rolling movement along the guiding means, could be replaced by sliding means, so that in the course of displacing the processing devices the supports could slide along the guiding means. Those assemblies which comprise—like the assemblies 3, 703, 903—two or more processing devices loosenably fastened in the same frame, allow for the possibility of mounting in one shelf two or more processing devices built as slide-in units next to each other and without lateral separating members.

The various processing devices and particularly the processing device 39 adapted for producing rows of holes to run along the longitudinal margins of the web, as well as the processing devices 87 and 271 adapted to cut off sheets or to produce predetermined tear lines to run transversely to the longitudinal direction of the web, may be constructed—instead of as cassette-like slide-in unit insertable into shelves—to have them loosenably mounted in some different manner into the various assemblies. At the same time the supports of the processing devices could be replaced by components being part of the frame of the respective apparatus.

The apparatus shown in FIGS. 1 and 18 could also be modified in a way to have its feed spool 15 separated from the remaining apparatus and designed as a separate unit; furthermore, one additional device corresponding to the device 893 could be incorporated into the apparatus for converting documents into folded letters that can be mailed.

The webs of which the documents and/or the envelopes are produced could consist, for example, of several layers, and comprise, for example, a paper layer and an additional metal layer, or a layer of a material for making copies, or it could consist of a multilayered self-gluing paper. Furthermore, the webs could consist of a plastic or a carton-like material, they should, however, be flexible enough to make their processing possible.

The functions of the computer 1 and of the computer belonging to the control means 93 may evidently be performed by one and the same computer. This computer could either be part of the apparatus 3, or it may be provided separate from the latter. Furthermore, the printing devices and/or the various drive devices may be controlled by computing and controlling means working in analog fashion rather than by digitally working computing equipment.

While there is shown and described present preferred embodiments of the invention, it is to be distinctly understood that the invention is not limited thereto but may be otherwise variously embodied and practiced within the scope of the following claims.

What is claimed is:

1. Apparatus for providing a flexible web with cuts running in the transverse direction of the web, comprising: a support; two processing members operatively held in the support, each of the processing members comprising at least one knife and at least one of the processing members being rotatably mounted, and wherein the cutting edges of the knives belonging to different processing members are arranged to form an angle with each other and at least one of the cutting edges being arranged to form an angle different than 90° with the transporting direction of the web; a holding member arranged to support at least one processing member is adjustably held in the support so that at least one processing member is pivotably disposed around a pivot axis that runs at a right angle to the axis of rotation of at least one of said rotatable processing members; transporting means for conveying the web past the two processing members; and drive means for driving at least one of said rotatable processing members so that the cutting edges of the knives cross each other during the cutting process in a crossing point subject to displacement along said cutting edges, said drive means comprising a gear rotatably supported in the support, wherein said gear is in engagement with a mating gear connected with at least one of said rotatable processing members supported by the holding member, and is provided for transmitting the driving motion onto the mating gear, and wherein the teeth of the two gears have, in a view perpendicular to the rotational axis of the respective gear, flanks convexly curved so that the axes of rotation of the two gears may be tilted relative to each other around a pivot axis arranged to cross said axes of rotation and to pass through the teeth of the two gears.

2. Apparatus as claimed in claim 1, wherein the cutting edges of the knives of both processing members are arranged to have no interruptions and thereof being adapted to cut up the web into sheets.

3. Apparatus as claimed in claim 1, wherein the cutting edge of at least one of said knives of at least one of the processing members is arranged to comprise interruptions for cutting perforations into the web, to thus form predetermined tear lines.

4. Apparatus as claimed in claim 1, wherein the transporting means and the drive means are adapted so that the angular velocity of at least one of said rotatable processing members is proportional to the transporting velocity of the web, to produce cuts which run substantially at right angles to the longitudinal transporting direction of the web.

5. Apparatus as claimed in claim 1, further comprising a frame and wherein the processing members are elongated in length and the transporting means comprises at least one transporting member movably supported in the frame and adapted to engage the web for conveying the web, the support and the elongated processing members supported at their respective opposite ends by the support being arranged to form together a slide-in unit, and wherein there are also provided guiding means adapted to dispalceably guide the support on the frame and securing means adapted to secure the support against displacements, in its working position predetermined for operation.

6. Apparatus as claimed in claim 5, wherein said first mentioned gear is torsionally rigidly connected with a further gear rotatably supported by the support, and wherein the drive means comprises an electric motor mounted on the frame and an additional gear supported for rotation in the frame and arranged to be rotated by the motor, said additional gear being separably connected with said further gear which is rotatably supported in the support when said further gear is in its working position.

7. Apparatus as claimed in claim 6, wherein when the support is in the working position, said further gear rotatably supported by the support and said additional gear supported for rotation in the frame have teeth in engagement with each other.

8. Apparatus as claimed in claim 6, further comprising a shaft rotatably supported in the support, wherein said first mentioned gear rotatably supported by the support is loosenably mounted on said shaft, and at least one of said rotatable processing members is torsionally rigidly mounted on a further shaft supported rotatably in said holding member, and wherein said mating gear is torsionally rigidly and loosenably mounted on to said further shaft so that the rotational speed of the rotatable processing member mounted on said further shaft can be changed by changing said first mentioned gear and said mating gear in relation to the transport velocity of the web.

9. Apparatus as claimed in claim 1, wherein both processing members supported by said holding member are adjustably held in the support and wherein all of the knives are rigidly mounted so that their cutting edges are parallel to an intermediary plane disposed between the two processing members and are parallel to the axis of rotation of at least one of the rotatably mounted processing members.

10. Apparatus as claimed in claim 1, wherein one of said processing members comprises a shaft held by said holding member and has an axis which can cross the axis of the first mentioned gear rotatably supported by the support.

11. Apparatus as claimed in claim 10, further comprising means for securing at least one of said processing members against rotation.

12. Apparatus as claimed in claim 10, wherein said shaft of at least one of said processing members is rotatably supported in said holding member and wherein there are provided coupling means for torsionally rigidly coupling said shaft of the respective processing member with said first mentioned gear rotatably supported by the support.

13. Apparatus as claimed in claim 1, wherein said pivot axis is defined by the teeth of said first mentioned gear and of said mating gear.

14. Apparatus for providing a flexible web with cuts running in the transverse direction of the web, comprising: a processing device with a support and two elongated processing members which are held at opposite ends in the support, each of the processing members comprising at least one knife and at least one of the processing members being rotatably mounted, and wherein the cutting edges of the knives belonging to different processing members are arranged to form an angle with each other and at least one of the cutting edges being arranged to form and angle different than 90° with the transporting direction of the web; transporting means for conveying the web past the two processing members; drive means for driving at least one of said rotatable processing members so that the cutting edges of the knives cross each other during the cutting process in a crossing point subject to displacement along said cutting edges; and a frame, wherein said transporting means comprises at least one transporting member movably supported in the frame and adapted to engage the web for conveying the web, the support and the processing members supported by the support being arranged to form together a slide-in unit, and wherein there are also provided guiding means adapted to displaceably guide the support on the frame and securing means adapted to secure the support against displacements, in its predetermined working position.

15. Apparatus as claimed in claim 14, wherein the drive means comprises an electric motor mounted on the frame and a first gear supported for rotation in the frame and arranged to be rotated by the motor, and a second gear supported for rotation in the support and connected with at least one of the rotatable processing members, said second gear being in separable connection with the first gear when the second gear is in its working position, and wherein in the working position of the support, the two gears have teeth in engagement with each other.

16. Apparatus as claimed in claim 14, comprising a further processing device adapted to process the web and comprising a support and at least a rotatable processing member, the further processing device being arranged to form a slide-in unit, and there are also provided guiding means adapted to displaceably guide the support on the frame and securing means adapted to secure the support against displacements in its working position, the drive means comprises a further gear supported for rotation in the frame and arranged to be rotated by said motor or a further motor mounted on the frame; said further processing device further comprises a gear supported for rotation in the support and connected with at least one of the processing members of said further processing device, said latter gear being in separable connection with the further gear rotatably supported in the support, when the further gear is in its working position and wherein in the working position of the support, the two gears have teeth in engagement with each other.

17. Apparatus as claimed in claim 16, wherein the at least one of said processing devices comprises two rotatably mounted processing members adapted for providing the web at each of its two longitudinal margins with a row of holes running in the longitudinal direction of the web.

18. Apparatus as claimed in claim 17, wherein both processing members of the first mentioned processing device comprising said knives and of the further processing device adapted for providing the web with rows of holes running in the longitudinal direction of the web comprise a shaft supported in a holding member disposed adjustably around a pivot axis that runs at a right angle to the axis of the two shafts of the respective processing device.

19. Apparatus as claimed in claim 16, wherein at least one of the processing devices is adapted to print information upon the web.

20. Apparatus as claimed in claim 16, wherein the supports of at least one of the processing devices are substantially identical and wherein said gears supported rotatably in said support are arranged so that processing devices with the processing members adapted for carrying out different operations on a web are mountable as a slide-in unit on the guiding means.

21. Apparatus as claimed in claim 16, wherein the supports of at least one of the processing devices are substantially identical and wherein said gears supported rotatably in said support are arranged so that processing devices with the processing members adapted for carrying out different operations on a web are mountable as a slide-in unit on an additional guiding means.

* * * * *